US006142347A

United States Patent [19]

Kolton et al.

[11] Patent Number: 6,142,347

[45] Date of Patent: Nov. 7, 2000

[54] SECURITY GARMENT HANGER

[75] Inventors: Chester Kolton, Westfield; Michael Norman, East Brunswick, both of N.J.

[73] Assignee: B&G Plastics, Inc., Newark, N.J.

[21] Appl. No.: 09/465,605

[22] Filed: Dec. 17, 1999

[51] Int. Cl.[7] ..... A47G 25/14

[52] U.S. Cl. ..... 223/85

[58] Field of Search ..... 223/85, 88, 92

[56] References Cited

U.S. PATENT DOCUMENTS 5,738,255 4/1998 Wilms ..... 223/92

5,988,462 4/1999 Kolton ..... 223/85

*Primary Examiner*—Bibhu Mohanty

*Attorney, Agent, or Firm*—Robin, Blecker & Daley

[57] ABSTRACT

A hanger assembly is comprised of a plastic body having a central portion and garment supporting arms extending respectively outwardly of the central portion, the central portion having a generally I-beam shaped configuration having an interior upstanding part extending to upper and lower flanges which extend forwardly and rearwardly outwardly of the interior upstanding part, a recess being formed in the interior upstanding part extending from a front wall of the interior upstanding part, the recess being bounded in part by a rear wall extending rearwardly outwardly of the interior upstanding part to a location coincident with rear surfaces of the upper and lower flanges, and an EAS marker being resident in the recess, an opaque recess closure member secured to the hanger in overlying relation to the EAS marker.

8 Claims, 4 Drawing Sheets

SECURITY GARMENT HANGER

FIELD OF THE INVENTION

This invention relates generally to hangers for garments and pertains more particularly to hangers having theft-deterrent capability.

BACKGROUND OF THE INVENTION

A widespread practice in article security is the use of socalled anti-theft tags which incorporate electronic article surveillance (EAS) markers. Such tags are secured to articles and are removed or rendered inactive at checkout. Where fraudulent avoidance of checkout (shop-lifting) occurs, the markers are sensed by EAS systems, e.g., at store exits, and suitable alarm is generated.

One form of EAS marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

In commonly-assigned U.S. Pat. No. 5,988,462, applicants herein provide a security hanger having an EAS marker therewith and not visible to a customer.

Such garment hanger of the referenced patent application is comprised of a one-piece body having a hook portion for the receipt of a display rod, a central portion depending from the hook portion and a lower portion for engagement with an article to be displayed. The central portion defines a recess opening into an otherwise continuous front surface of the central portion, the recess being of dimensions suited for residence of an EAS marker in the hanger. A bar code label or like recess closure member is affixed to the central portion exterior surface in contiguous overlying relation therewith and enclosing the resident EAS marker.

The hanger of the referenced patent application is of a thickness accommodating the formation of the EAS marker receiving recess, i.e., the recess extends from the continuous front surface of the hanger body to a depth toward a continuous rear surface of the hanger body sufficient for containment of the EAS marker. With the recess closure member affixed over the EAS marker, the presence of the EAS marker is unknown to the purchaser.

SUMMARY OF THE INVENTION

In the subject invention, applicants address the matter of providing a security facility for garment hangers which do not have a depth between front and rear hanger body surfaces for containment of the EAS marker.

In attaining this objective, applicants address a hanger having a central portion containing an EAS marker and having transversely-extending arms for engagement with an article to be displayed.

More particularly, the invention provides a hanger assembly comprised of a plastic body having a central portion and garment supporting arms extending respectively outwardly of the central portion, the central portion having an interior upstanding part extending to a flange which extends forwardly and rearwardly outwardly of the interior upstanding part, a recess being formed in the interior upstanding part extending from a front wall of the interior upstanding part, the recess being bounded in part by a rear wall extending rearwardly outwardly of the interior upstanding part to a location coincident with a rear surface of the flange, and an EAS marker being resident in the recess, an opaque recess closure member secured to the hanger in overlying relation to the EAS marker.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS

Figure 1:
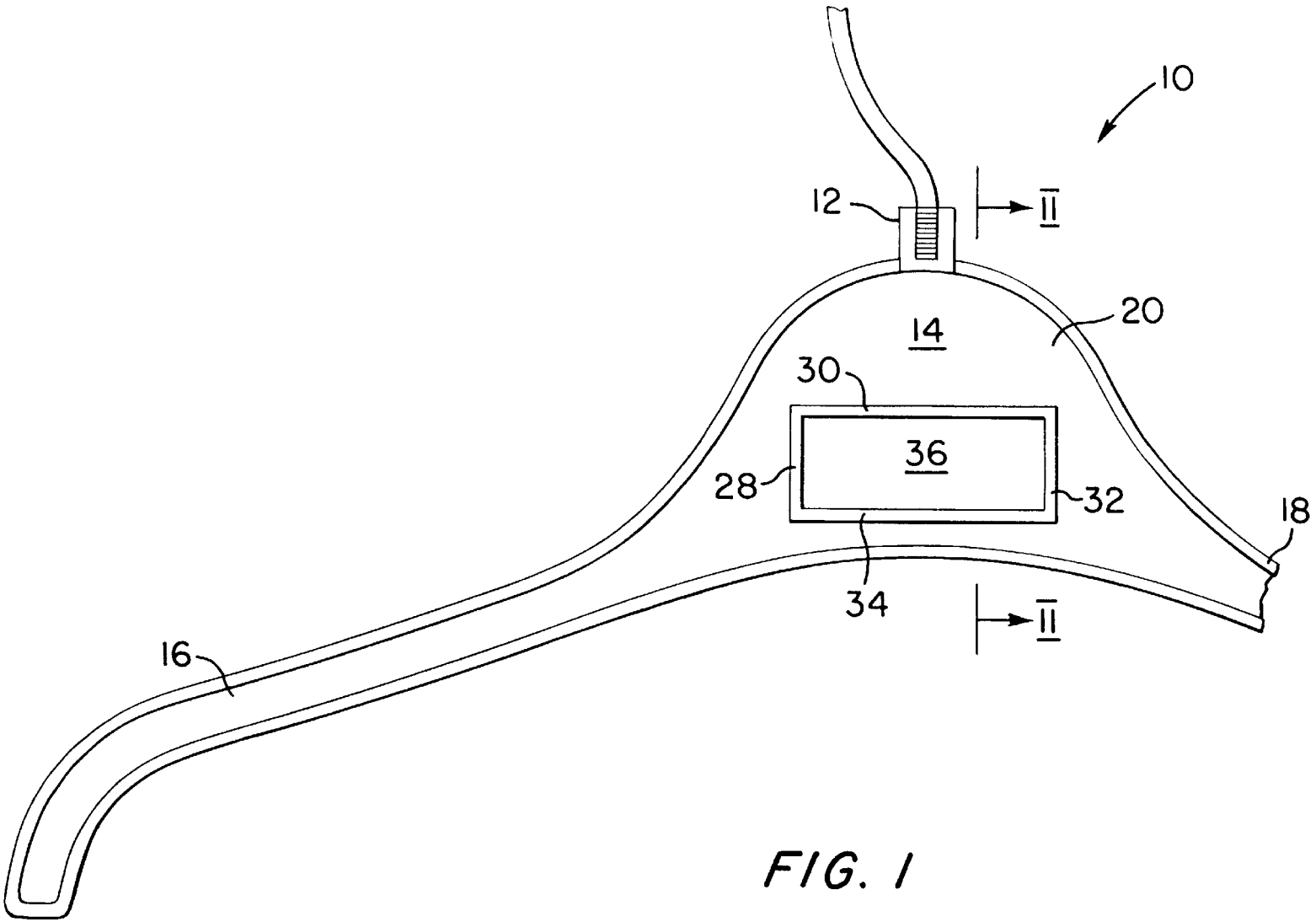
FIG. 1 is a partial front elevation of a first embodiment of a hanger body in accordance with the invention.
Figure 2:
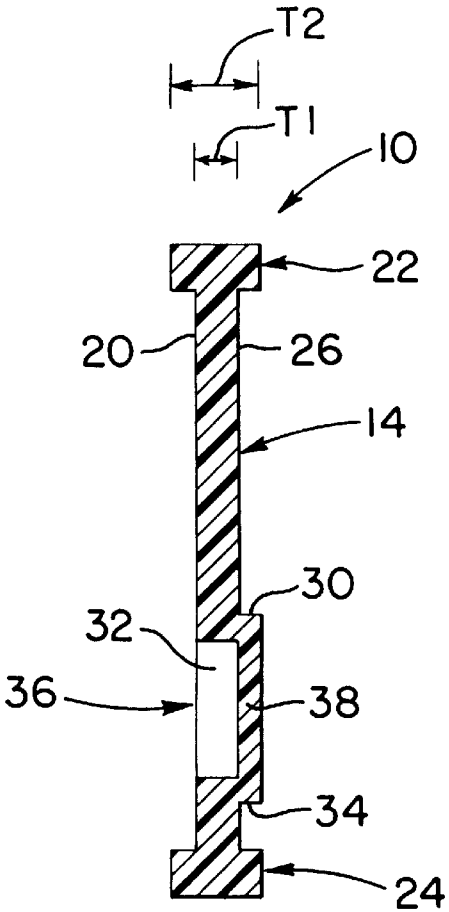
FIG. 2 is a sectional view of the FIG. 1 hanger body as would be seen from plane II—II of FIG. 1.

Referring to FIGS. 1 and 2, hanger 10 is comprised of a plastic body having a hook receipt portion 12, a central portion 14 depending from portion 12 and garment supporting arms 16 and 18 extending respectively outwardly of central portion 14.

Central portion 14 has a generally I-beam shaped configuration having a front surface 20 of thickness T1 adjacent upper and lower flanges 22 and 24 which extend forwardly of front surface 20 and rearwardly of central portion 14 rear surface 26, flanges 22 and 24 being of thickness T2, which exceeds thickness T1 by about threefold. As will be appreciated, flanges 22 and 24 provide reinforcement to hanger 10 and permit plastic material savings in the making of central portion 14. On the other hand, in its thickness T1, central portion 14 does not afford depth permitting the formation of a recess therein for containment of an EAS marker.

In addressing such problem, applicants form rectangular walls 28, 30, 32 and 34 extending from front surface 20 to a depth coinciding with the rearward faces of flanges 22 and 24 and thus form a recess 36 bounded by walls 28, 30, 32 and 34, the recess being rearwardly closed by rear wall 38, which connects walls 28, 30, 32 and 34 to one another. As will be further appreciated, walls 28, 30, 32, 34 and 38 provide further reinforcement to hanger 10.

Figure 3:
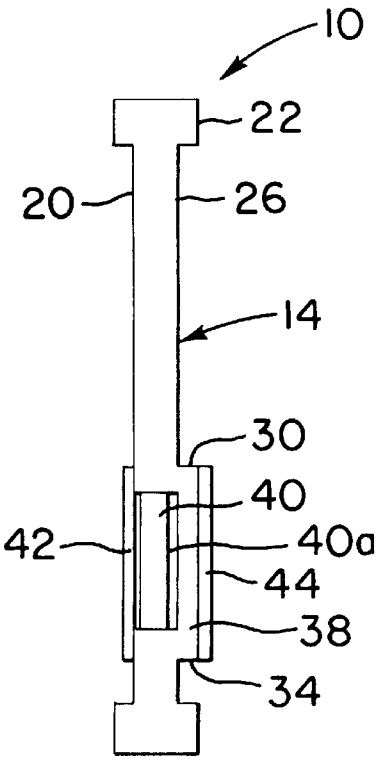
FIG. 3 is a repeat showing (without sectioning) of FIG. 2, with the hanger body assembled with an EAS marker and a recess closure member to provide a first embodiment of a hanger in accordance with the invention.

Turning to FIG. 3, the showing of FIG. 2 is repeated (without sectioning) with EAS marker 40 resident in recess 36, being adhesively bound by adhesive 40a to rear wall 38. If the material of hanger 10 is opaque, single recess closure member 42, adhered to the front of EAS marker, is sufficient to conceal the presence of EAS marker 40 in hanger 10. If the material of hanger 10 is transparent, a second recess closure member 44 is applied to outwardly to rear wall 38.

Figure 4:
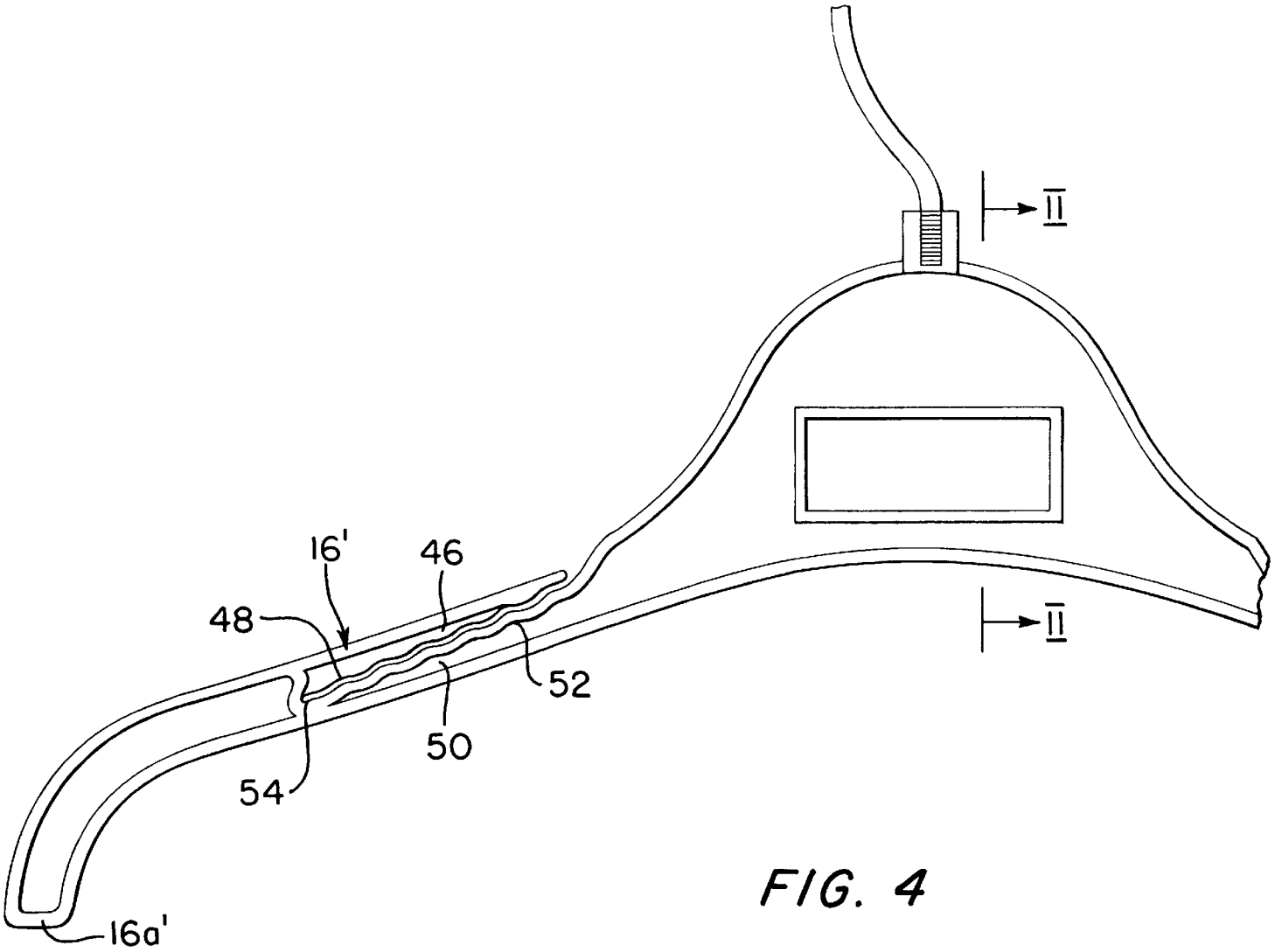
FIG. 4 is a partial front elevation of a second embodiment of a hanger in accordance with the invention.

While arms 16 and 18 of the first embodiment are shown as not including any garment retaining detents, FIG. 4 shows arm 16' having upper arm part 46 with lower serrated surface 48 and lower arm part 50 with upper serrated surface 52. A fulcrum 54 is defined where the arm parts are joined, and downward movement of arm end 16*a'* gives rise to variation in the spacing between the serrated surfaces 48 and 52, facilitating insertion of garment parts onto arm 16'.

Figure 5:
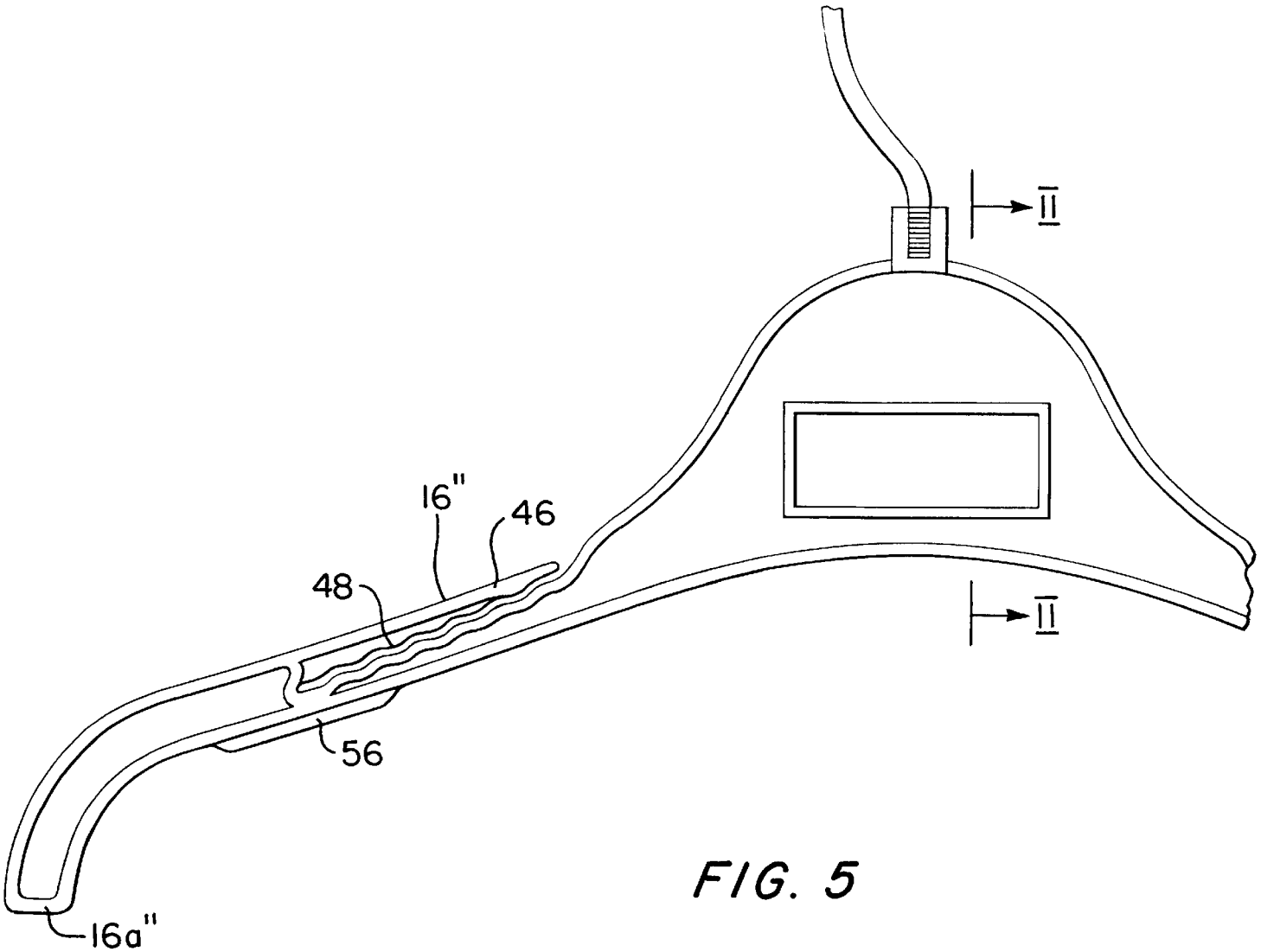
FIG. 5 is a partial front elevation of a third embodiment of a hanger in accordance with the invention.

Turning to FIG. 5, arm 16" is configured essentially the same as arm 16' of FIG. 4, except for plastic mass 56, which serves to limit the downward movement of arm end 16*a*".

In summary of the foregoing, the invention will be seen to provide, in its preferred, illustrated embodiments, a hanger assembly comprised of a plastic body having a central portion and garment supporting arms extending respectively outwardly of the central portion, the central portion having a generally I-beam shaped configuration having an interior upstanding part extending to upper and lower flanges which extend forwardly and rearwardly outwardly of the interior upstanding part, a recess being formed in the interior upstanding part extending from a front wall of the interior upstanding part, the recess being bounded in part by a rear wall extending rearwardly outwardly of the interior upstanding part to a location coincident with rear surfaces of the upper and lower flanges, and an EAS marker being resident in the recess, an opaque recess closure member secured to the hanger in overlying relation to the EAS marker.

The plastic body may be comprised on an opaque material or of a transparent material, in which case the hanger assembly further comprises a further opaque recess closure member being secured to the rear wall.

The hanger assembly plastic body may include a hook portion upwardly of the central portion. At least one of the arms may include mutually displaceable portions for facilitating receipt of a garment part. The hanger assembly mutually displaceable portions may define respective facing serrated surfaces. The at least one arm may include means for limiting displacement of the mutually displaceable portions.

Various changes may be introduced in the disclosed preferred embodiments without departing from the invention. Accordingly, it is to be appreciated that the true spirit and scope of the invention is set forth in the following claims.

What is claimed is:

1. A hanger assembly comprised of a plastic body having a central portion and garment supporting arms extending respectively outwardly of the central portion, the central portion having an interior upstanding part extending to a flange which extends forwardly and rearwardly outwardly of the interior upstanding part, a recess being formed in the interior upstanding part extending from a front wall of the interior upstanding part, the recess being bounded in part by a rear wall extending rearwardly outwardly of the interior upstanding part to a location coincident with a rear surface of the flange, and an EAS marker being resident in the recess, an opaque recess closure member secured to the hanger in overlying relation to the EAS marker.

2. The hanger assembly claimed in claim 1, wherein said plastic body is comprised on an opaque material.

3. The hanger assembly claimed in claim 1, wherein said plastic body is comprised of a transparent material, said hanger assembly further comprising a further opaque recess closure member being secured to said rear wall.

4. The hanger assembly claimed in claim 1, wherein said plastic body includes a hook portion upwardly of said central portion.

5. The hanger assembly claimed in claim 1, wherein at least one of said arms includes mutually displaceable portions for facilitating receipt of a garment part.

6. The hanger assembly claimed in claim 5, wherein said mutually displaceable portions define respective facing serrated surfaces.

7. The hanger assembly claimed in claim 5, wherein said at least one arm includes means for limiting displacement of said mutually displaceable portions.

8. The hanger assembly claimed in claim 6, wherein said at least one arm includes means for limiting displacement of said mutually displaceable portions.

* * * * *

UNITED STATES PATENT AND TRADEMARK OFFICE

CERTIFICATE OF CORRECTION

PATENT NO. : 6,142,347
DATED : November 7, 2000
INVENTOR(S) : Chester Kolton et al.

It is certified that error appears in the above-identified patent and that said Letters Patent is hereby corrected as shown below:

Column 1,
Line 11, delete "socalled" and insert -- so-called --.

Signed and Sealed this

Eighteenth Day of December, 2001

*Attest:*

*Attesting Officer*

JAMES E. ROGAN
*Director of the United States Patent and Trademark Office*